US005816427A

United States Patent [19]

Beckertgis

[11] Patent Number: 5,816,427

[45] Date of Patent: Oct. 6, 1998

[54] INSECT-PROOF AND TAMPER-EVIDENT COVER FOR BEVERAGE CONTAINER

[76] Inventor: Nicholas G. Beckertgis, 1320 N. 4th St., Sheboygan, Wis. 53081-3540

[21] Appl. No.: 682,939

[22] Filed: Jul. 16, 1996

[51] Int. Cl.[6] ..... B65D 51/18

[52] U.S. Cl. ..... 220/253; 220/258; 220/269

[58] Field of Search ..... 220/253, 258, 220/268, 269

[56] References Cited

U.S. PATENT DOCUMENTS

| | | | |
|---|---|---|---|
| 3,726,432 | 4/1973 | Gentile | 220/253 |
| 3,874,580 | 4/1975 | Weatherhead, III | 220/253 X |
| 3,889,842 | 6/1975 | Bennett | 220/253 |
| 5,072,849 | 12/1991 | Blau | 220/253 |
| 5,193,704 | 3/1993 | Kick | 220/253 |
| 5,205,430 | 4/1993 | Valyi | 220/278 |
| 5,269,432 | 12/1993 | Beckertgis . | |
| 5,421,472 | 6/1995 | Beckertgis . | |

*Primary Examiner*—Stephen Cronin

[57] ABSTRACT

An insect-proof and tamper-evident cover is disclosed for a disposable, one-time use beverage container. A lid, non-rotatably secured to the upper end of the beverage container, includes an initially sealed lid opening, an arcuate groove housing a projection used to break the sealed lid opening, and a plurality of bearing surfaces. A rotatable cover is secured to said lid in a fluid-tight arrangement. The cover includes a fluid opening having parallel bars there-across, a plurality of finger engaging members, and a tamper evident indicator.

10 Claims, 3 Drawing Sheets

INSECT-PROOF AND TAMPER-EVIDENT COVER FOR BEVERAGE CONTAINER

BACKGROUND OF THE INVENTION

It is well-known in the art of beverage containers to provide soft drink cans and beer cans with metal tops, and these usually have a pull-ring device or pull-tab device by which the user of the can gains access to the contents. The pull-ring or pull-tab is generally disposed or, in some cases, can be bent inwardly into the can so as to provide a fluid-accessible opening. Unfortunately, when such a container is opened and the contents partially consumed, quite often bees, wasps, mosquitoes, flies or other insects are attracted to the sugar-sweet contents and enter the container unnoticed. Thereafter, when the contents are consumed, the user quite often swallows and is injured by the insects. In the United States, several hundreds of deaths each year are occasioned by the stings of bees or wasps which have been swallowed while drinking the contents of such a beverage container.

Furthermore, it has long been known to provide a container for condiments, such as spices, salt, sugar or the like, with a 2-piece cover or cap arranged so that one portion acts as a closure and the other portion acts as a spout. When the two elements are in one position, the openings are covered by portions of the closure, and when the closure is rotated, the openings are exposed and the contents can be dispensed.

The prior art in this field of closures or covers for beverage containers or devices to protect the contents, including devices to prevent access to the interior by insects or the like, are shown in the following patents:

| | | |
|---|---|---|
| Beckertgis | U.S. Pat. No. 5,269,432 | 12/14/1993 |
| Thorn | U.S. Pat. No. 2,121,554 | 06/21/1938 |
| Rivas | U.S. Pat. No. 3,160,309 | 12/08/1964 |
| Gentile | U.S. Pat. No. 3,726,432 | 04/10/1973 |
| Morehead | U.S. Pat. No. 4,537,326 | 08/27/1985 |
| Kacalieff | U.S. Pat. No. 4,611,725 | 09/16/1986 |
| Ayyoubi | U.S. Pat. No. 4,717,039 | 01/05/1988 |
| Gabrys | U.S. Pat. No. 4,846,374 | 07/11/1989 |
| Dimberio | U.S. Pat. No. 4,852,763 | 08/01/1989 |
| Cerrone | U.S. Pat. No. 4,869,389 | 09/26/1989 |
| Englert | U.S. Pat. No. 4,880,136 | 11/14/1989 |
| Hall | U.S. Pat. No. 4,901,877 | 02/20/1990 |
| Thibeqault | U.S. Pat. No. 4,930,654 | 06/05/1990 |
| Levine | U.S. Pat. No. 5,125,525 | 06/30/1992 |
| Kick | U.S. Pat. No. 5,167,338 | 12/01/1992 |

Of these, the most relevant, because they refer to the prior art relating to insect-preventing closures are Beckertgis U.S. Pat. No. 5,269,432; Morehead U.S. Pat. No. 4,537,326; Cerrone U.S. Pat. No. 4,869,389; Hall U.S. Pat. No. 4,901,877 and Tucker U.S. Pat. No. 5,125,525.

While all of these devices have merit, they have distinguishing features which make them either economically or commercially unsatisfactory and, more particularly, difficult for the consumer to use.

Thus the prior art fails to disclose the protective closure of the present invention, which can be easily and simply operated by the consumer, which assures the sanitariness of the contents while yet permitting easy removal thereof, which also provides for protection against access to the interior of the container by unwanted insects, which includes a tamper-evident device, and which can be manufactured economically so that such device can be discarded along with the used container.

One object of the present invention is to provide a tamper-evident and insect-proof cover for disposable metal beverage containers.

A further object of the present invention is to provide a closure for a beverage container which not only serves as an insect-preventing device, but also permits use and re-use of the container while the contents are intermittently consumed.

Still a further object of the present invention is to provide a tamper-evident reclosable insect-proof cover for a beverage container, which can be easily operated by one hand.

SUMMARY OF THE INVENTION

The present invention relates to a metal beverage container, such as soft drink containers, beer cans, fruit and vegetable cans, and the like and, more particularly, to a permanently attached rotatable cover for such can for preventing insects from getting into the can.

The cover includes a circular or disc-shaped lid which is permanently and non-rotatably seamed to the top edge of the can in a fluid-tight and air-tight manner. This portion has a lid opening, a pivot opening, a depressed arcuate groove, a depression, and a plurality of bearing surfaces formed therein.

Affixed to the lid by means of a pin or rivet is a rotatable cover which has a fluid opening therein similar in shape to the opening in the lid. The fluid opening includes one or more bars across its width. The bars within the fluid opening are spaced a predetermined distance from one another such that one or more elongated fluid openings are formed. With the opening in the cover rotated into alignment with the opening in the lid, the contents can flow therethrough, but very small insects cannot gain access past the screen to the interior of the container.

The assembly is also provided with a means to limit the amount of rotation of the cover with respect to the lid, and a tamper-indicating arrangement to advise the user whether the can has been previously opened.

With the above and other objects in view, more information and a better understanding of the present invention may be achieved by reference to the following detailed description.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention which is defined by the claims.

Figure 1:
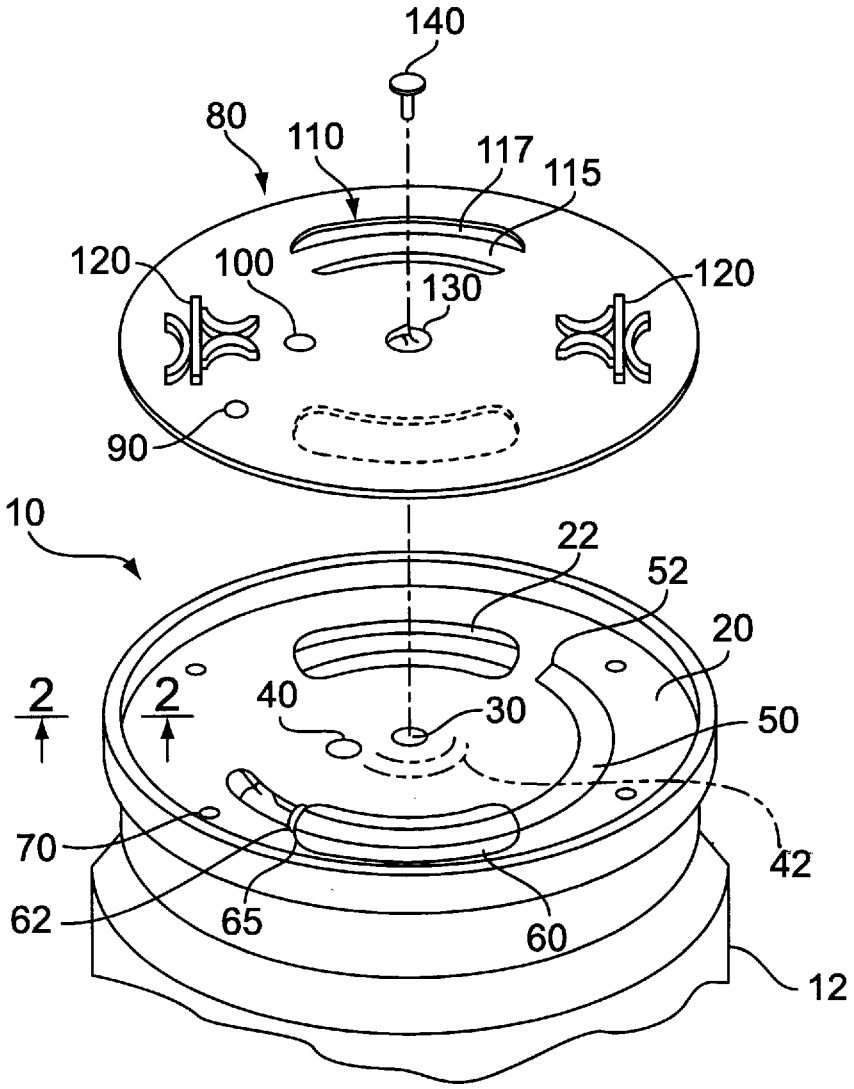
FIG. 1 is an exploded perspective view of my cover for a beverage container.
Figure 2:
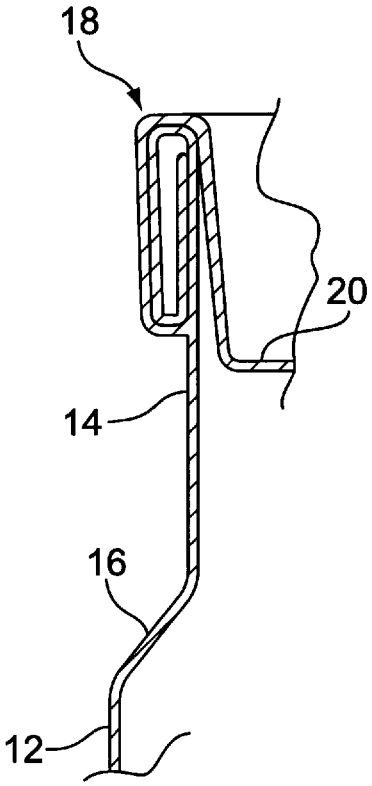
FIG. 2 is a vertical cross-sectional view taken generally along line 2—2 of FIG. 1.

The present invention, shown generally as 10 in the drawings, comprises a cover for a beverage can lid. Referring to FIG. 1, there is shown a metal beverage container 12, the upper end 14 of which is of a smaller diameter than the body of the container, with the sloping portion 16 being disposed intermediate the body of the container 12 and the upper end 14. As shown in FIG. 2, a top lid 20 is attached to the upper end 14 of a beverage container 12 by a double crimp interconnection shown generally at 18. The double crimp inter-connection provides an air tight seal between the upper end 14 of the beverage can 12 and the top lid 20.

The top lid 20, which is permanently crimped to the beverage can 12, has a pivot opening 30, a depression 40, a depressed arcuate groove 50, a lid opening 60, and a plurality of bearing surfaces 70 formed therein. Referring to FIG. 1, it can be seen that four bearing surfaces 70 are used in the preferred embodiment, but it is to be understood that any desirable number of surfaces 70 could be utilized. The depressed arcuate groove 50 passes through lid opening 60 such that there are predetermined portions of depressed arcuate groove 50 on each side of lid opening 60. In order to avoid leakage, the lid opening 60 is initially sealed. The top lid 20 further includes a plurality of elongated embossed portions 22, diametrically opposed to the lid opening.

Figure 3:
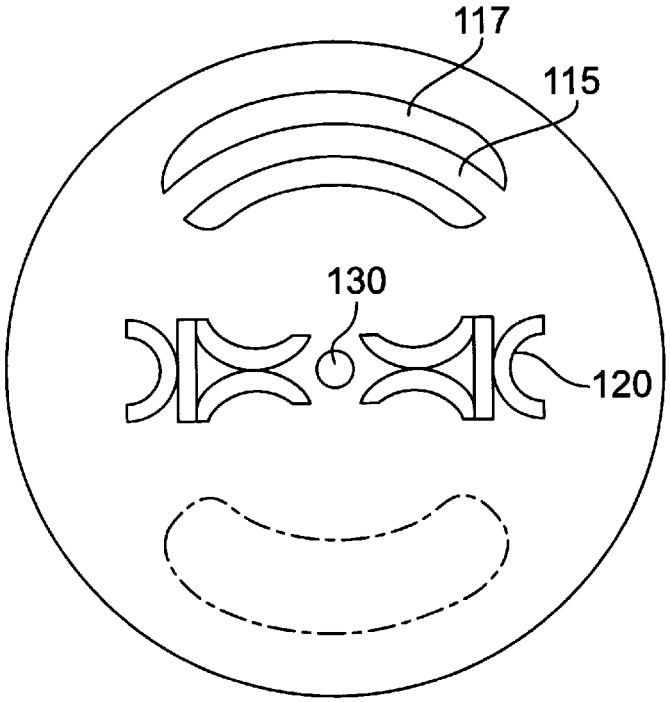
FIG. 3 is a top view of the rotatable cover.

Referring to FIGS. 1 and 3, a rotatable cover 80 comprises a first projection 90, a second projection 100, a fluid opening 110, a plurality of finger-engaging members 120, and a pin opening 130. The first projection 90 rides within the arcuate groove 50. The second projection 100 is positioned in cover 80 such that it comes into alignment with depression 40. The fluid opening 110 comprises a plurality of parallel bars 115, spaced a predetermined distance from one another, such that one or more elongated fluid openings 117 are formed. In the closed position, the elongated fluid openings 117 on the rotatable cover 80 are in substantial alignment with the elongated embossed portions 22 on the top lid 20, such that each elongated embossed portion 22 nests within an elongated fluid opening 117. The lid opening 60 includes a weakened portion 65, comprising a series of fine strips.

The finger-engaging members are formed in the outer surface of the cover 80 and provide a means by which the user of my invention 10 can rotate cover 80 relative to top lid 20 in order to open the beverage container 12. The inner surface of the cover 80 is substantially flat and smooth. This inner surface rides on bearing surfaces 70 formed in top lid 20.

As shown in FIG. 1, cover 80 is placed over top lid 20. A rivet or pin 140 passes through the opening 130 in the cover 80 and through the opening 30 in the top lid 20 thus securing the cover 80 to the top lid 20 and permitting the cover 80 to be rotated about the inner perimeter of the top lid 20.

When the cover 80 is placed over top lid 20, the first projection 90 engages the depressed arcuate groove 50. In the closed position, the first projection 90 rides within the depressed arcuate groove 50 adjacent to lid opening 60. As cover 80 is rotated and first projection 90 comes into contact with lid opening 60, projection 90 depresses the weakened portion 65 of the lid opening 60 downward and into the beverage container 12. This action opens the previously sealed beverage container 12 and releases the pressure collected inside the container 12. The first projection 90 continues to depress the lid opening 60, folding it along edge 62 into the container 12. As the user of my invention continues to rotate cover 80, the projection 90 re-enters the depressed arcuate groove 50 on the side opposite the lid opening 60. The depressed arcuate groove 50 continues a predetermined distance to its end 52. When projection 90 reaches groove end 52, the fluid opening 110 of cover 80 is in substantial alignment with the lid opening 60.

Figure 4:
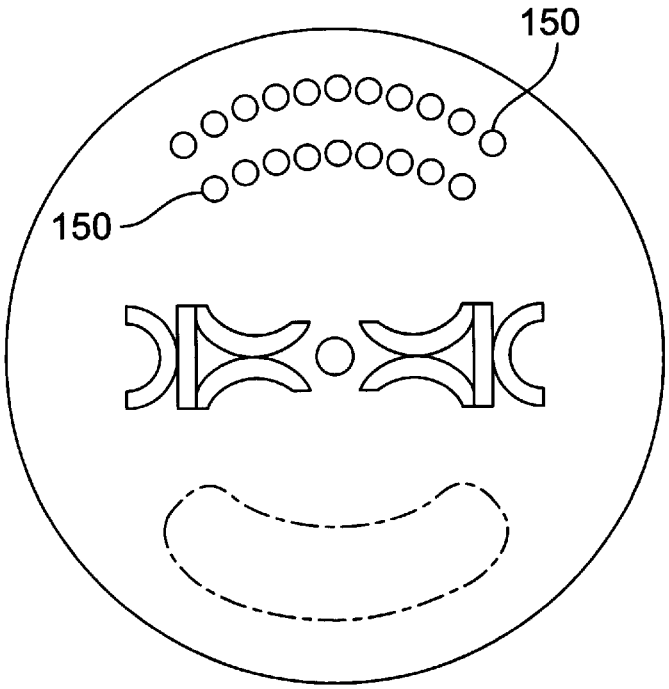
FIG. 4 is a top view of an alternative embodiment of the rotatable cover.

Referring to FIG. 4, an alternative embodiment of the rotatable cover 80 is shown having a plurality of circular fluid openings 150 that replace the elongated fluid openings 117.

My invention 10 also includes a tamper-evident feature. In the closed position, second projection 100, formed within the cover 80, is nested within depression 40, formed within the top lid 20. When the cover 80 is rotated from the closed position to the open position, projection 100 collapses and forms an arcuate groove 42 within the upper surface of top lid 20. Thus if the user of my invention 10 rotates cover 80 and feels no resistance, it is evident that the beverage container 12 was previously opened.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A cover assembly for disposable metal beverage containers, said cover assembly comprising:

a top lid structure, said top lid structure being attached to said metal beverage container; a rotatable cover, said rotatable cover having at least one finger-engaging member attached thereto;

said top lid structure having a pivot opening and a lid opening formed therein, a plurality of bearing surfaces formed therein, a depression formed therein, and an arcuate groove formed therein, said arcuate groove extending through said lid opening;

said rotatable cover having a pin opening and a fluid opening formed therein;

a pin, said pin passing through said pivot opening and said pin opening.

2. The cover assembly of claim 1, wherein said lid opening of said top lid structure has an edge and further comprises a weakened portion located on a segment of said edge, said weakened portion having a plurality of strips.

3. The cover assembly of claim 1, wherein said rotatable cover further comprises:

a first projection, said first projection of said rotatable cover nested within said arcuate groove of said top lid structure;

a second projection, said second projection of said rotatable cover being aligned with said depression on said top lid structure.

4. The cover assembly of claim 1, wherein said fluid opening of said rotatable cover comprises a grate.

5. The cover assembly of claim 4, wherein said grate includes a plurality of parallel bars; said bars forming therein a plurality of elongated fluid openings.

6. The cover assembly of claim 1, wherein said top lid structure further includes a plurality of elongated embossed portions.

7. The cover assembly of claim 6, wherein said elongated embossed portions on said top lid structure nest within said elongated fluid openings on said rotatable cover.

8. A cover assembly for disposable metal beverage containers, said cover assembly comprising:

a top lid structure, said top lid structure being attached to said metal beverage container, and having a pivot opening, a lid opening, a plurality of bearing surfaces, a depression, and an arcuate groove formed therein;

said arcuate groove of said top lid structure extending through said lid opening of said top lid structure;

said lid opening of said top lid structure having an edge and a weakened portion located on a segment of said edge, said weakened portion having a plurality of strips;

said top lid structure further including a plurality of elongated embossed portions;

a rotatable cover, said rotatable cover having at least one finger-engaging member attached thereto, a pin opening, and a fluid opening formed therein;

said rotatable cover further comprising a first projection nesting within said arcuate groove of said top lid structure, and a second projection aligning with said depression on said top lid structure;

said fluid opening of said rotatable cover having a grate, said grate including a plurality of parallel bars, said parallel bars forming therein a plurality of elongated fluid openings;

said elongated embossed portions on said top lid structure nesting within said elongated fluid openings on said rotatable cover;

a pin, said pin passing through said pivot opening of said top lid structure, and said pin opening of said rotatable cover.

9. A method for opening a metal beverage container, having a top lid structure including a lid opening formed therein, and an arcuate groove formed therein, also having a rotatable cover pivotally secured to said top lid structure, including a first projection, said first projection nested within said arcuate groove on said top lid structure, a second projection, said second projection being aligned with said depression on said top lid structure, a plurality of finger-engaging members, and a fluid opening, said method comprising:

rotating said rotatable cover using said finger-engaging members;

engaging said first projection within said arcuate groove with said lid opening;

collapsing said second projection within said depression on said top lid structure;

depressing the lid opening downward and into said metal beverage container;

aligning said fluid opening on said rotatable cover with said lid opening on said top lid structure.

10. A method for opening a metal beverage container, having a top lid structure including a lid opening formed therein, and an arcuate groove formed therein, also having a rotatable cover pivotally secured to said top lid structure, including a projection, said projection nested within said arcuate groove on said top lid structure, a plurality of finger-engaging members, and a fluid opening, said method comprising:

rotating said rotatable cover using said finger-engaging members;

engaging said projection within said arcuate groove with said lid opening;

depressing the lid opening downward and into said metal beverage container;

aligning said fluid opening on said rotatable cover with said lid opening on said top lid structure.

* * * * *